United States Patent [19]

Itami et al.

[11] Patent Number: 5,007,214

[45] Date of Patent: Apr. 16, 1991

[54] OPENABLE DOME-SHAPED ROOF STRUCTURE

[75] Inventors: Takashi Itami; Tadao Yuri, both of Tokyo; Toru Aoyagi, Chofu, all of Japan

[73] Assignee: Ohbayashi Corporation, Osaka, Japan

[21] Appl. No.: 504,906

[22] Filed: Apr. 5, 1990

[30] Foreign Application Priority Data

| | | | |
|---|---|---|---|
| Apr. 10, 1989 | [JP] | Japan | 1-88085 |
| Apr. 28, 1989 | [JP] | Japan | 1-107757 |
| Oct. 19, 1989 | [JP] | Japan | 1-270427 |
| Nov. 9, 1989 | [JP] | Japan | 1-290096 |
| Nov. 17, 1989 | [JP] | Japan | 1-297510 |

[51] Int. Cl.[5] ..... E04B 1/346

[52] U.S. Cl. ..... 52/66; 52/64

[58] Field of Search ..... 52/66, 82, 64, 65

[56] References Cited

U.S. PATENT DOCUMENTS

| | | | |
|---|---|---|---|
| 4,587,775 | 5/1986 | Lewis et al. | 52/66 X |
| 4,706,419 | 11/1987 | Adachi et al. | 52/66 X |
| 4,716,691 | 1/1988 | Allen et al. | 52/64 X |
| 4,727,688 | 3/1988 | Kida et al. | 52/66 X |
| 4,738,057 | 4/1988 | Logan | 52/66 X |
| 4,751,800 | 6/1988 | Kida | 52/66 |
| 4,942,698 | 7/1990 | Kumagi | 52/66 X |

*Primary Examiner*—Richard E. Chilcot, Jr.
*Assistant Examiner*—Creighton Smith
*Attorney, Agent, or Firm*—Wenderoth, Lind & Ponack

[57] ABSTRACT

An openable dome-shaped roof structure is provided upon a circular side wall and comprises a crescent-shaped fixed roof section, a pair of pivotable roof sections and a pair of slidable roof sections. Each pivotable roof section is connected to a respective slidable roof section by a pivot at peripheral end portions thereof so that the pivotable roof section can rotate to a position above the slidable roof section. The slidable roof sections are each provided to be able to rotate toward the upper surface of the fixed roof section about the center of the circle of the side wall.

10 Claims, 9 Drawing Sheets

OPENABLE DOME-SHAPED ROOF STRUCTURE

BACKGROUND OF THE INVENTION

This invention relates to an openable dome-shaped roof structure mainly intended for application to a stadium and, more particularly, to an openable dome-shaped roof structure comprising three or more roof sections, wherein at least one of the roof sections rotates generally in a horizontal plane and at least one of the other roof sections slides along the same horizontal plane to widely open the roof.

Such a type of dome-shaped roof structure has been demonstrated at "SKYDOME" in Toronto, Canada. This roof structure comprises four roof sections in which one semi-dome shaped roof section is rotatable in a horizontal plane and the other roof sections are slidable in the same horizontal plane. In "SKYDOME", a hotel is constructed adjacent to a stadium and the slidable roof sections are moved to the top of the hotel when the dome-shaped roof of the stadium is to be opened. This means that in "SKYDOME" an adjoining building is required other than the stadium for supporting the slidable roof sections. This building has to be of a large scale enough to support the huge slidable roof sections.

Therefore, in order to construct the stadium with such a dome-shaped roof structure as set forth above, a vast amount of land is required, other than that required for the stadium, and additional investment is required for constructing the building adjacent to the stadium.

Furthermore, it is almost impossible to reconstruct an old stadium to a new one with the dome-shaped roof structure as set forth above, because the required additional land will not be available adjacent to the stadium for constructing a building for supporting the slidable roof sections.

SUMMARY OF THE INVENTION

Therefore, an object of the present invention is to provide an openable dome-shaped roof structure for a stadium which does not require an additional building adjacent to the stadium for supporting movable roof sections when the roof is to be opened.

Another object of the present invention is to provide an openable dome-shaped roof structure for a stadium in which movable roof sections are positioned one above the other to open the roof within an area surrounded by a peripheral side wall of the stadium.

Another object of the present invention is to provide an openable dome-shaped roof structure for a stadium in which movable roof sections are arranged symmetrically with respect to each other relative to a diametric line of a substantially circular peripheral side wall of the stadium so as to open the roof with good balance.

Another object of the present invention is to provide an openable dome-shaped roof structure including pivotable roof sections and slidable roof sections in which both the pivotable and slidable roof sections are moved in synchronization with each other to a maximum open position.

Still another object of the present invention is to provide an openable dome-shaped roof structure including pivotable roof sections and slidable roof sections wherein when the pivotable roof sections move in a descending direction to open the roof, the slidable roof sections move in an ascending direction, so as to reduce the driving force required for moving such roof sections.

In order to achieve the above objects, an openable roof structure according to the present invention comprises:

An openable dome-shaped roof structure comprising: a peripheral side wall;

a first slide guide means provided upon said side wall along a circle;

a crescent-shaped fixed roof section having an arc-shaped outer periphery fixedly supported by said side wall and an arc-shaped inner periphery;

a second slide guide means provided upon said fixed roof section along a circular arc which is concentric with said circle;

a pair of slidable roof sections provided above the level of said fixed roof section and symmetrically arranged relative to a first diametral line of said circle, which line divides said slidable roof sections into equal two parts, said slidable roof sections meeting with each other at a first point where said diametral line intersects with said circle at the opposite side of said fixed roof section, each said slidable roof section being defined by an outer arc portion extending along said circle from said first point to a respective second point where said arc-shaped outer and inner peripheries of said fixed roof section meet with each other, an inner arc portion extending along said arc-shaped inner periphery of said fixed roof section from said second point to a third point where said second slide guide means terminates, and a substantially linear portion extending from said first point to said third point;

a third slide guide means provided upon each said slidable roof section along and near said inner arc portion thereof;

a pair of pivotable roof sections symmetrically arranged relative to said diametral line in such a manner that said pivotable roof sections close a space of a dome-shaped roof not covered by said fixed roof section and said slidable roof sections, each said pivotable roof section being provided above the level of a respective said . slidable roof section and pivotably connected thereto at a position adjacent said first point;

means for pivotably moving said pivotable roof sections upon said slidable roof sections along said third slide guide means; and means for slidably moving said slidable roof sections upon said fixed roof section along said first and second slide guide means.

In one preferred form of the invention, a fourth slide guide means is provided upon said fixed roof section along said arc-shaped inner periphery thereof. Each said pivotable roof section has a first carriage means engagable with said third slide guide means and a second carriage means engagable with said fourth slide guide means. Said means for moving said pivotable roof sections is driven prior to the driving of said means for moving said slidable roof sections.

In another preferred form of the present invention, a pair of fourth slide guide means are provided upon said fixed roof section substantially in parallel to said first diametral line. Each of the pivotable roof sections has a first carriage means engagable with said third slide guide means and a second carriage means engagable with said fourth slide guide means. Said means for moving said pivotable roof sections and said means for moving said slidable roof sections are driven in synchronization with each other.

Other objects and features of the present invention will become apparent from the detailed description of the preferred embodiments thereof when taken in conjunction with the accompanying drawings, in which:

DETAILED DESCRIPTION OF THE PREFERRED EMBODIMENTS

A first embodiment of the present invention will be described with reference to FIG. 1 through FIG. 9.

Figure 1:
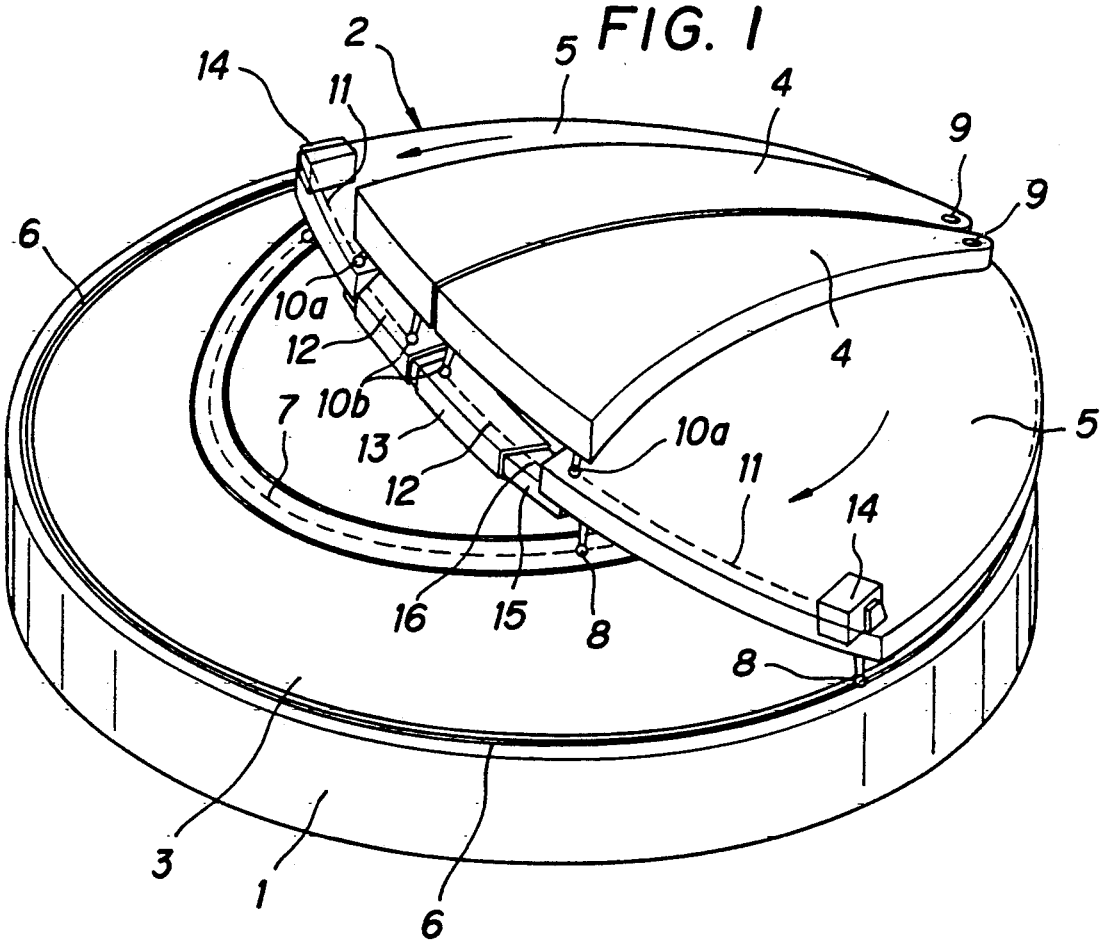
FIG. 1 is a schematic perspective view showing an openable dome-shaped roof structure according to a first embodiment of the present invention.

An openable dome-shaped roof structure is shown in FIG. 1 as applied to a stadium which has an outer peripheral side wall 1 of a substantially circular configuration in plan view. The side wall 1 is fixedly constructed on the ground and supports thereon the openable dome-shaped roof structure of the present embodiment.

Figure 2:
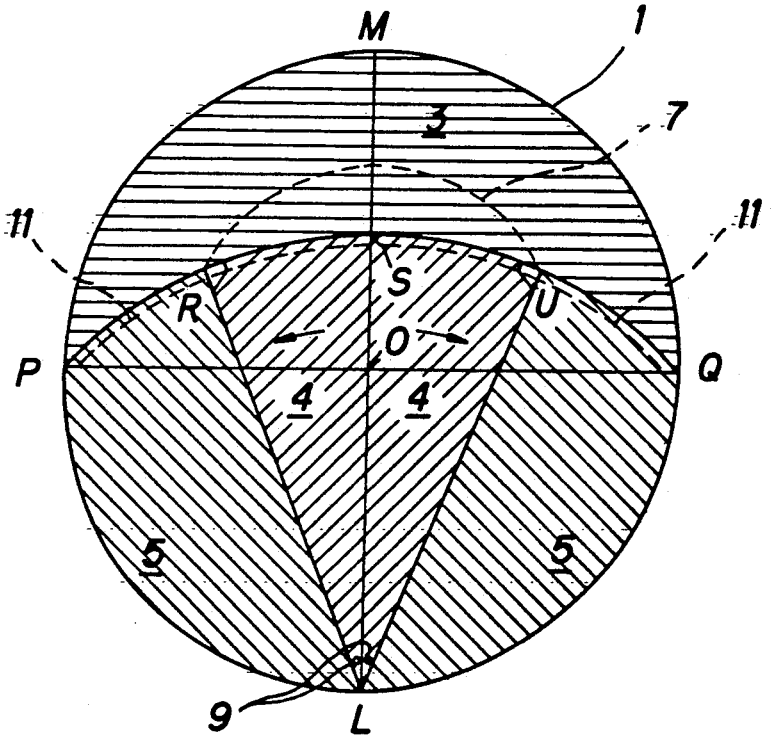
FIG. 2 is a geometrical plan view of the roof structure of the first in a closed position.

The roof structure 2, which extends over the side wall 1, comprises a crescent-shaped fixed roof section 3, a pair of pivotable roof sections 4, and a pair of slidable roof sections 5. FIG. 2 shows such roof structure in a geometrical plan view for easy understanding in which the side wall 1 is drawn as a circle round a center 0. Through the center 0 are drawn a vertical diametral line L-M and a horizontal diametral line P-Q. By making the length L-P as a radius, a circular arc P-Q is drawn round the point L. A point where the circular arc P-Q round L intersects with the vertical diametral line L-M is designated as S. The center of the circular arc P-S and also the center of the circular arc Q-S are respectively designated as R and U, so that the length of arc P-R or U-Q becomes one fourth of the length of arc P-Q.

The crescent-shaped fixed roof section 3 is defined by an external circular arc P-Q around the center 0 and by an internal circular arc P-Q around the center L.

The pair of pivotable roof sections 4 are provided symmetrically to the vertical diametral line L-M and arranged to contact each other along the line L-M. The pivotable roof sections 4 are each substantially triangular, one of which is defined by linear lines L-R and L-S and circular arc R-S, while the other of which is defined by linear lines L-S and L-U and circular arc S-U.

The pair of slidable roof sections 5 cover the other remaining parts of the circle of the side wall 1. That is, the slidable roof sections are symmetrically provided relative to the vertical diametral line L-M and are arranged to meet with eacn other at point L. One slidable roof section 5 is defined by two circular arcs L-P and P-R and linear line L-R, while the other is defined by two circular arcs L-Q and Q-U and linear line L-U.

The outer periphery of the fixed roof section 3 is firmly secured to the inner periphery of the circular side wall 1 of the stadium. This can be done easily since the curvature of the outer periphery of the fixed roof section 3 is substantially the same as that of the side wall 1. The side wall 1 has arranged on the upper surface thereof an external guide rail in the form of a circle. The fixed roof section 3 has thereon an arc-shaped internal guide rail 7, which is, as shown in FIG. 2 by a dotted line, formed as a circular arc R-U by a radius 0-R round the center 0, whereby the internal guide rail 7 is concentric with and parallel to the external guide rail 6.

Supported on the external and internal guide rails 6 and 7 to run thereon are the slidable roof sections 5. Each slidable roof section 5 has wheels 8 rotatably supported by brackets extending thereunder. At least three wheels are necessary on each slidable roof section 5 adjacent to its three corners. For example, with respect to the left slidable roof section 5 shown in FIG. 2, at least one wheel is provided adjacent to each of points R, P and L. The wheel adjacent to point R rides on the internal guide rail 7, while the other two wheels adjacent to points P and L ride on the external guide rail 6. In order that the wheel 8 adjacent to point R can ride on the internal guide rail 7, the internal circular arc P-Q of the fixed roof section 3 extends radially beyond the circular arcs P-R and U-Q of the slidable roof sections 5—5.

The pivotable roof sections 4 are provided above the level of the slidable roof sections 5 and overlap at external side edges along lines L-R and L-U on the adjoining side edges of the slidable roof sections 5. The outer end portion of each pivotable roof section 4, which portion is adjacent to point L, is connected by a pivot 9 to the pivotable roof section 5, such that sections 4, 5 are overlapped one upon the other. To secure such a pivotable connection, the slidable roof section 5 may have a flange or bracket extending below the outer end portion of the pivotable roof section 4.

Each pivotable roof section 4 has at least two wheels 10a–10b rotatably supported thereunder adjacent to the respective inner circular arc R-S or S-U. One of the wheels 10a is supported by a shorter bracket and rides on a rail 11 provided on the respective slidable roof section 5 adjacent to the inner circular arc P-R or Q-U, while the other wheel 10b is supported by a longer bracket and rides on a rail 12 provided on a beam 13 securely mounted on the fixed roof section 3. The outer peripheral edge of each slidable roof section 5, adjacent to the fixed roof section 3, has a winch 14 that is connected with the respective pivotable roof section 4 in such a manner that when the winch 14 is wound from the position shown in FIG. 1, the wheels 10a and 10b of the pivotable roof section 4 are moved along the rails 11 and 12 toward the outer periphery of the slidable roof section 5, so that the pivotable roof section 4 is positioned above the slidable roof section 5. At the final stage of movement of the pivotable roof section 4, the wheel 10b running on the rail 12 on the beam 13 of the fixed roof section 3 has to be detached form the rail 12, so that the entire weight of the pivotable roof section 4 can be supported by the slidable roof section 5.

Figure 3:
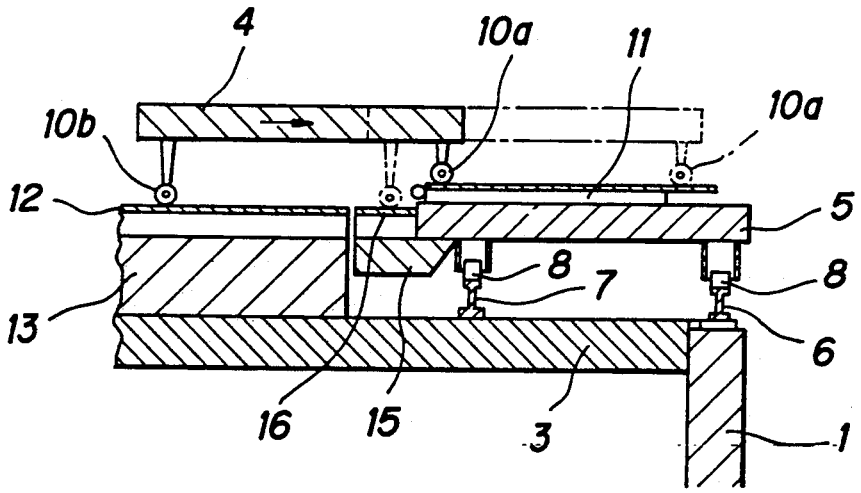
FIG. 3 is a vertical sectional view showing a pivotable roof section guided to rest upon a slidable roof section.

To this end, as shown in FIG. 3, a bracket 15 is fixedly provided at the underside of the slidable roof section 5 and a supplemental rail 16 is mounted on the bracket 15 such that the upper level of the supplemental rail 16 becomes flush with that of the rail 12 on the beam 13 and that the space between the rails 12 and 16 is narrow enough to allow the wheel 10b to be smoothly transferred from one rail to the other.

Figure 4:
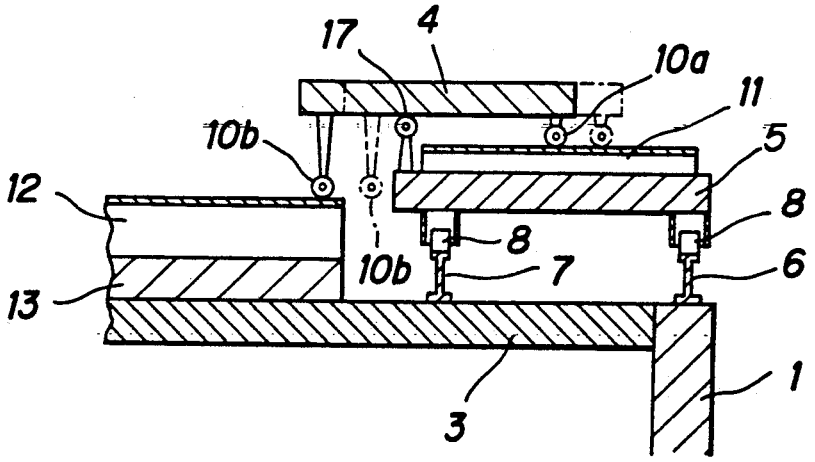
FIG. 4 is a vertical sectional view showing another manner of how the pivotable roof section is guided to rest upon the slidable roof section.

FIG. 4 shows another structure to achieve the same effect as set forth above and wherein, instead of the supplemental rail 16 in FIG. 3, a roller 17 is provided on a support projecting upwardly from the inner edge of the slidable roof section 5. The roller 17 normally contacts the bottom surface of the pivotable roof section 4 and supports the pivotable roof section 4 together with the outer side wheel 10a when the inner side wheel 10b is detached from the rail 12 on the beam 13.

Figure 5:
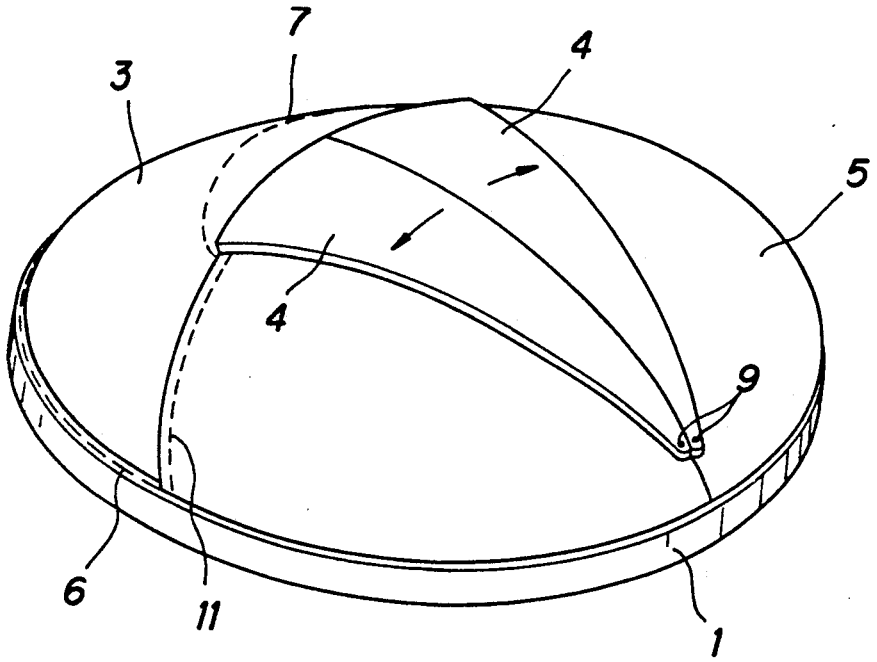
FIG. 5 is another schematic perspective view similar to FIG. 1.
Figure 6:
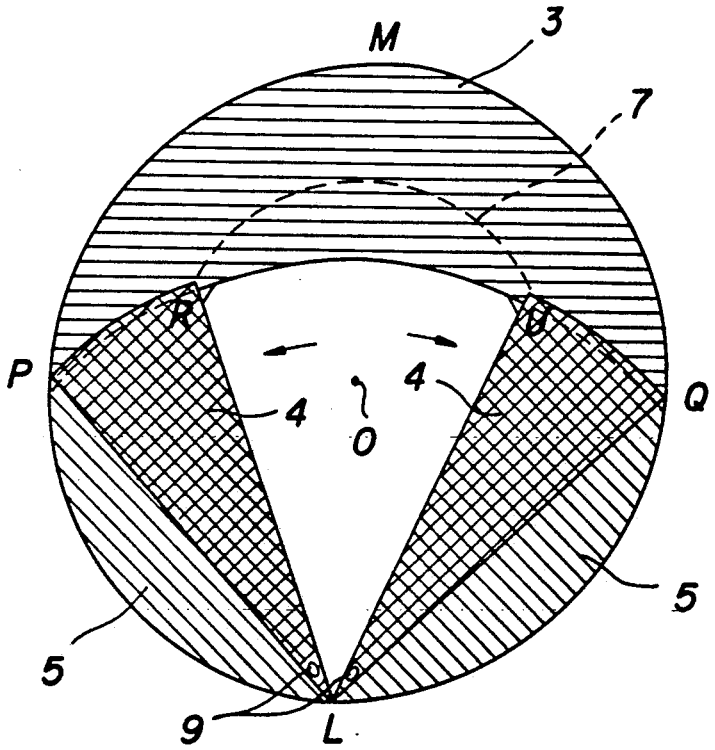
FIG. 6 is a geometrical plan view of the roof structure of the first embodiment in a partially opened position.
Figure 7:
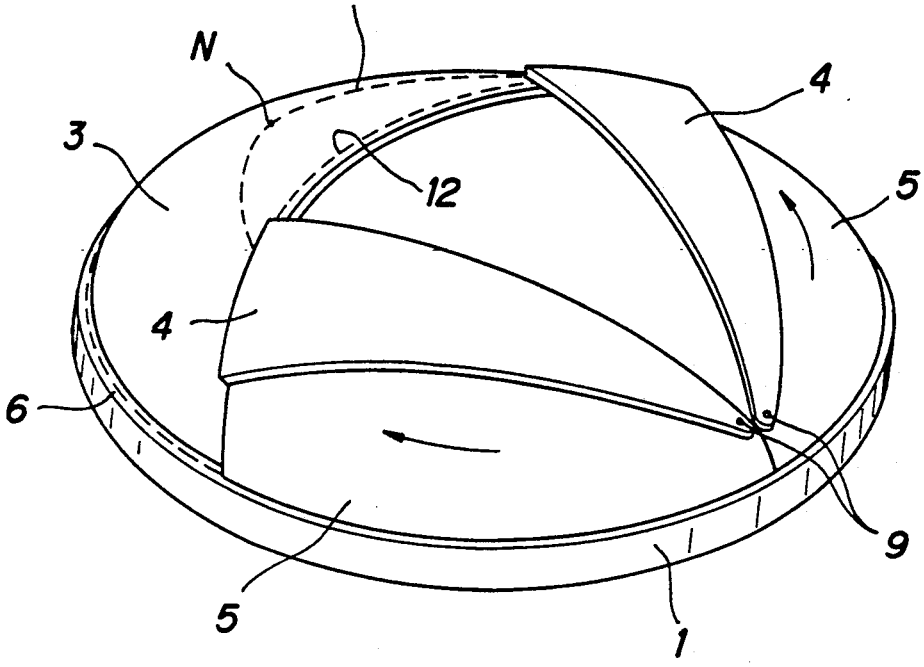
FIG. 7 is a schematic perspective view of the roof structure in the partially opened position as shown in FIG. 6.
Figure 8:
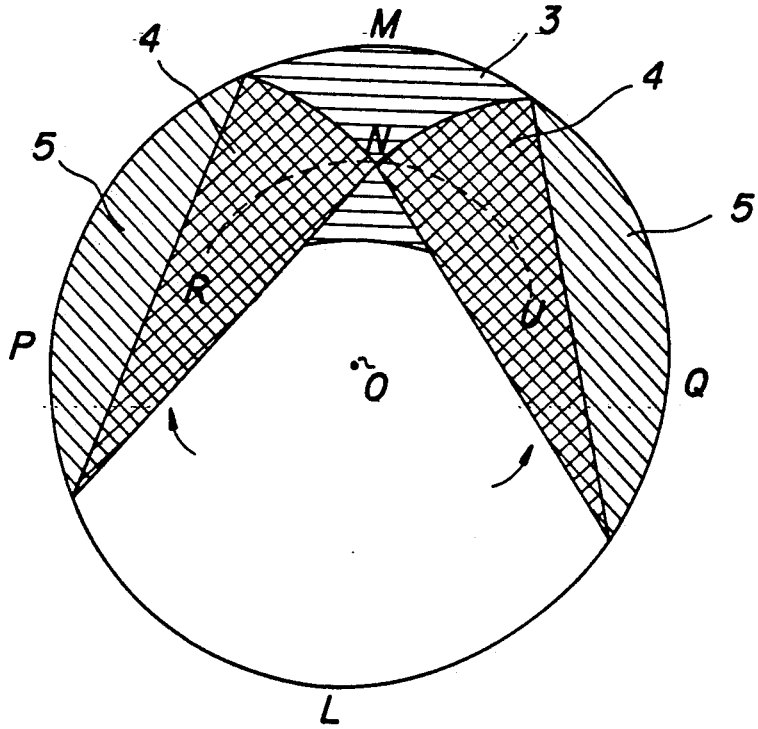
FIG. 8 is a geometrical plan view of the roof structure of the first in a fully opened position.
Figure 9:
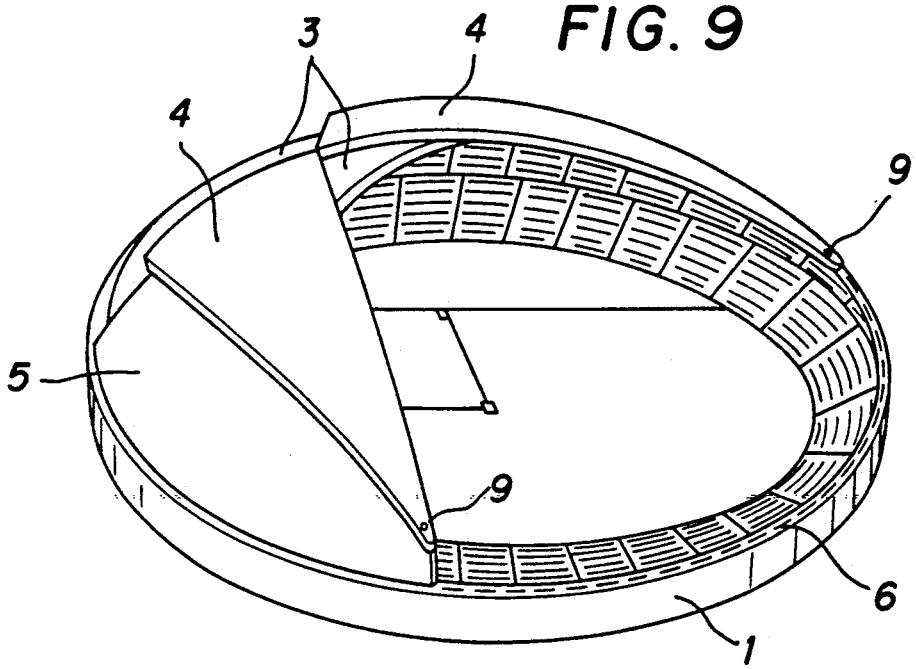
FIG. 9 is a schematic perspective view of the roof structure in the fully opened position as shown in FIG. 8.

The roof structure of the present embodiment is closed as shown in FIGS. 1, 2 and 5 as the combination of all of the roof sections 3, 4 and 5 forms a dome shape or circular shape in plan view. When the winches 14 are wound as mentioned above from the above closed position of the roof structure, the pivotable roof sections 4 are rotated about the pivots 9 until each pivotable roof section 4 is positioned completely above the respective slidable roof section 5 as shown in FIGS. 6 and 7, whereby a substantially triangular shaped space, defined by linear lines L-R and L-U and circular arc R-U in FIG. 6, is open in the dome-shaped roof. Then, the slidable roof sections 5 over which are positioned the pivotable roof sections 4 are moved or rotated by other winches 18, which can be provided at the center part of the fixed roof section 4 as shown in FIG. 1, along the rail 6 on the side wall 1 and rail 7 on the fixed roof section about the center point 0 of the circle defining the side wall. The two slidable roof sections 4 can move until the inner edges shown by R and U in FIG. 6 contact each other at a point N shown in FIG. 8, where a major part of each slidable roof section is positioned above the fixed roof section 3 and a maximum open space in the shape of fan is formed in the dome-shaped roof as shown in FIGS. 8 and 9.

To close the open space in the dome-shaped roof, the slidable roof sections 5 and pivotable roof sections 4 are moved in directions reverse to those set forth above.

Figure 10:
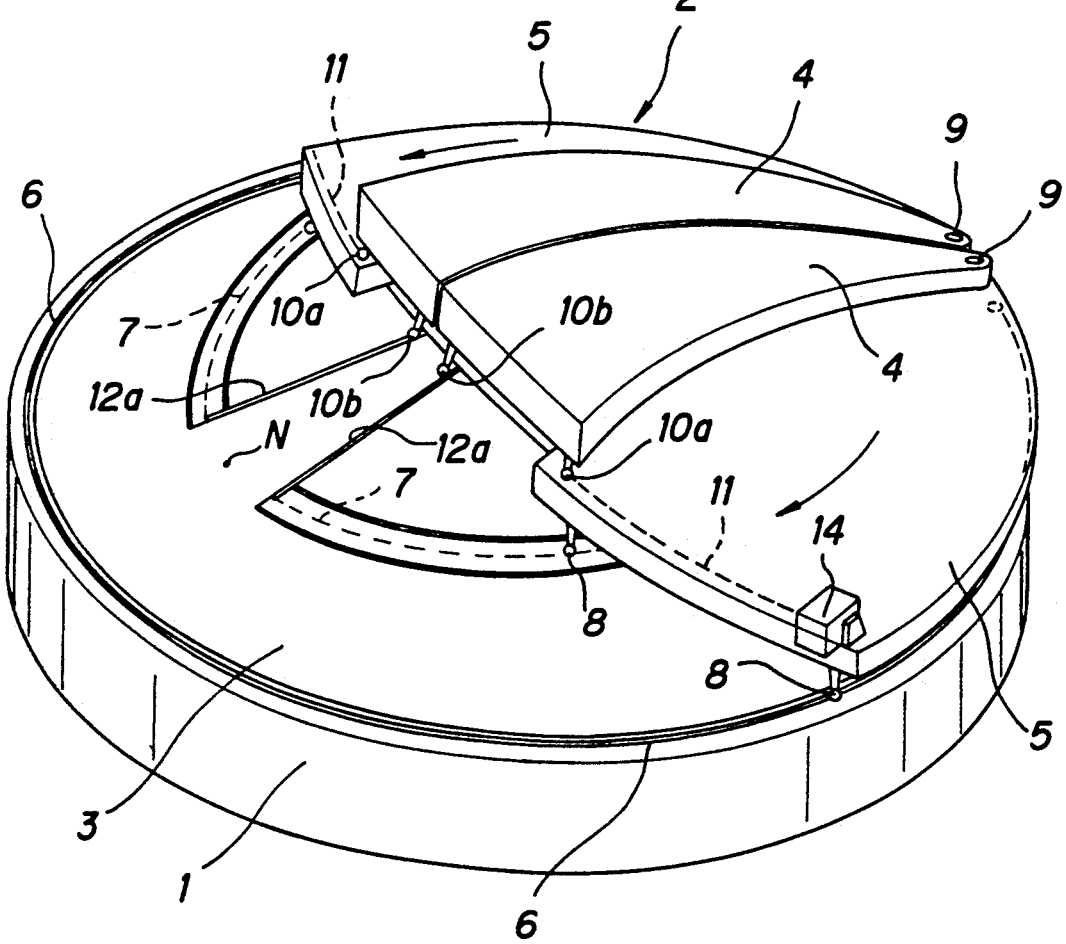
FIG. 10 is a schematic perspective view showing an openable dome-shaped roof structure according to a second embodiment of the present invention.
Figure 11:
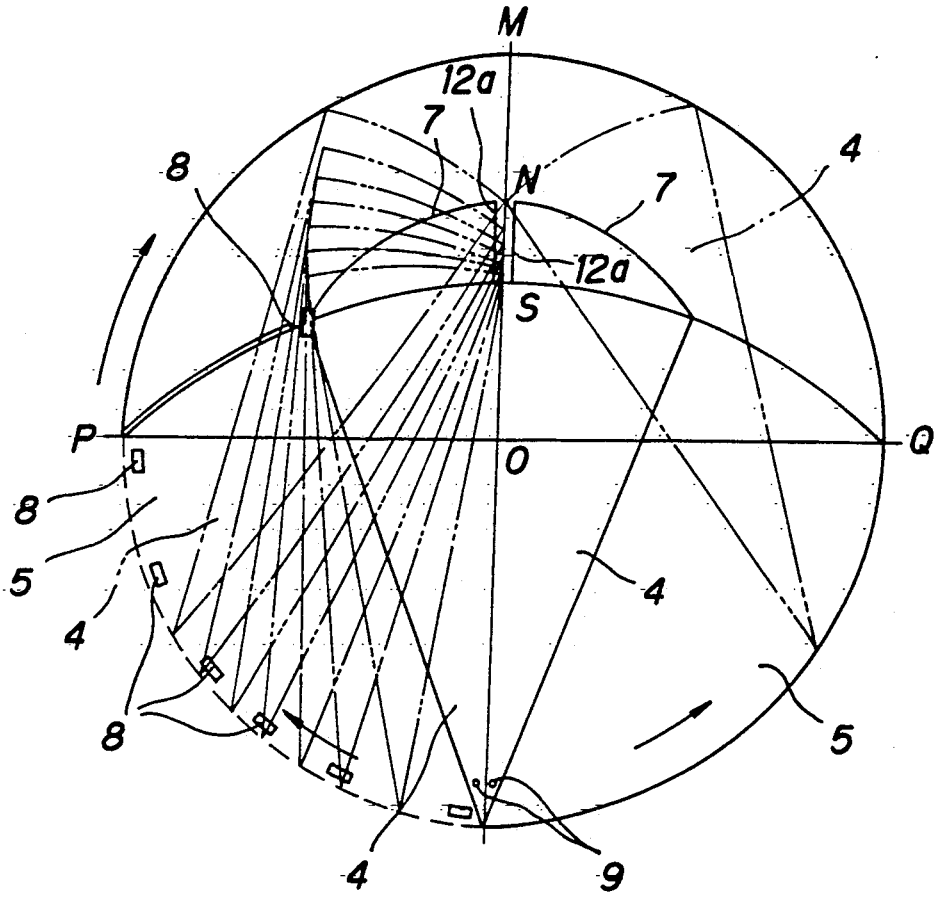
FIG. 11 is a geometrical plan view of the roof structure of the second embodiment showing how a pivotable roof section moves in timed sequence.

Reference is now made to a second embodiment of the dome-shaped roof structure according to the present invention shown in FIGS. 10 and 11. In this embodiment, the same reference numerals are employed to designate the same parts as in the first embodiment.

The roof structure 2 of the second embodiment comprises a fixed roof section 3, a pair of pivotable roof sections 4, and a pair of slidable roof sections 5. These roof sections have substantially the same shapes and configurations as in the first embodiment. The fixed roof section 3 is fixedly secured to the inner periphery of the circular side wall 1. Each pivotable roof sections 4 is pivotably connected to a respectivethe slidable roof section 5. Each slidable roof section 5 is made to be rotatable along concentric guide rails 6 and 7, the former being provided on the upper surface of the circular side wall 1, and the latter being provided on the upper surface of the fixed roof section 3.

The above features of the second embodiment are substantially the same as those of the first embodiment. However, in the second embodiment, a pair of guide rails 12a, each of which is straight in plan view, are provided on the fixed roof section 3 instead of the arc-shaped guide rail 12 on the beam 13 as in the first embodiment. These guide rails 12a extend parallel to the diametral line M-L. Riding on each guide rail 12a is a wheel 10b which is rotatably supported beneath the respective pivotable roof section 4 at an inner corner portion thereof, i.e. at the inner side of the circular arc R-S of S-U of the pivotable roof section 4. Another wheel 10a, which is also rotatably supported beneath the pivotable roof section 4 at the outer corner portion thereof, rides on the rail 11 on the slidable roof section 5 as in the case of the first embodiment.

In the operation for opening the roof structure of the second embodiment, the pivotable roof sections 4 as well as the slidable roof sections 5 are moved synchronously toward the fixed roof section 3 by appropriate driving means such as winches used in the first embodiment. As it can be understood from FIG. 11, while each pivotable roof section 4 moves toward the fixed roof section 3 along the respective rail 12a, the pivotable roof section 4 is gradually caused to be overlapped above the respective slidable roof section 5 which is also gradually moved over the fixed roof section 3 by being rotated about the center point 0 of the curvature of the rails 6 and 7. When the pivotable roof section 4 reaches a position where the inner corner thereof is at point N, the pivotable roof section 4 is completely positioned above the slidable roof section 5. Also at this position, the inner corners of the two pivotable roof sections 4 contact each other at point N, so that no further movement of the pivotable roof sections 4 or the slidable roof sections 5 occurs. The maximum open space in the dome-shaped roof is substantially the same as in the first embodiment.

The second embodiment of the present invention has the advantage over the first embodiment in that the maximum open space in the dome-shaped roof is formed by a single operation of synchronously moving the pivotable roof sections and the slidable roof sections.

Figure 12:
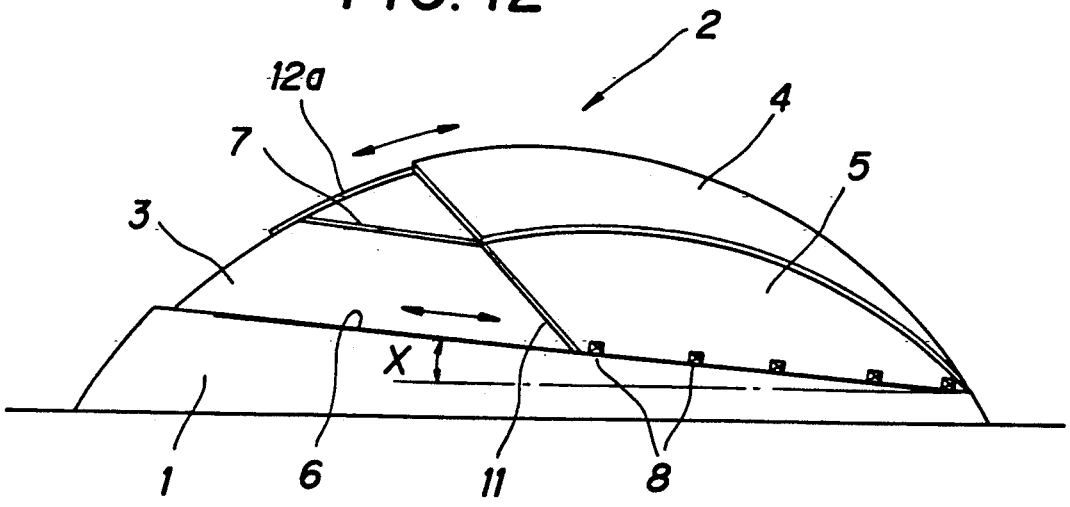
FIG. 12 is a schematic side view showing an openable dome-shaped roof structure according to a third embodiment of the present invention.
Figure 13:
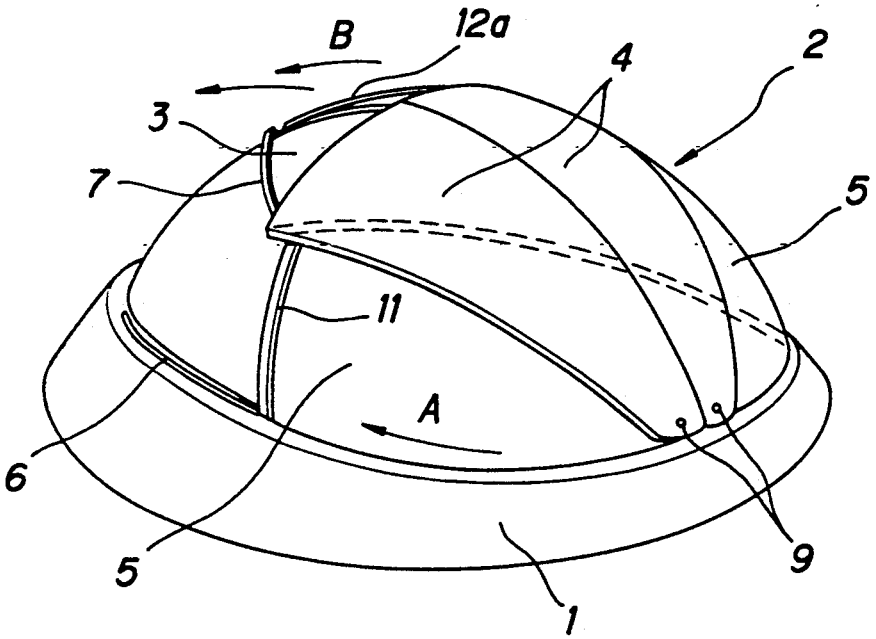
FIG. 13 is a perspective view of the same roof structure as FIG. 12.
Figure 14:
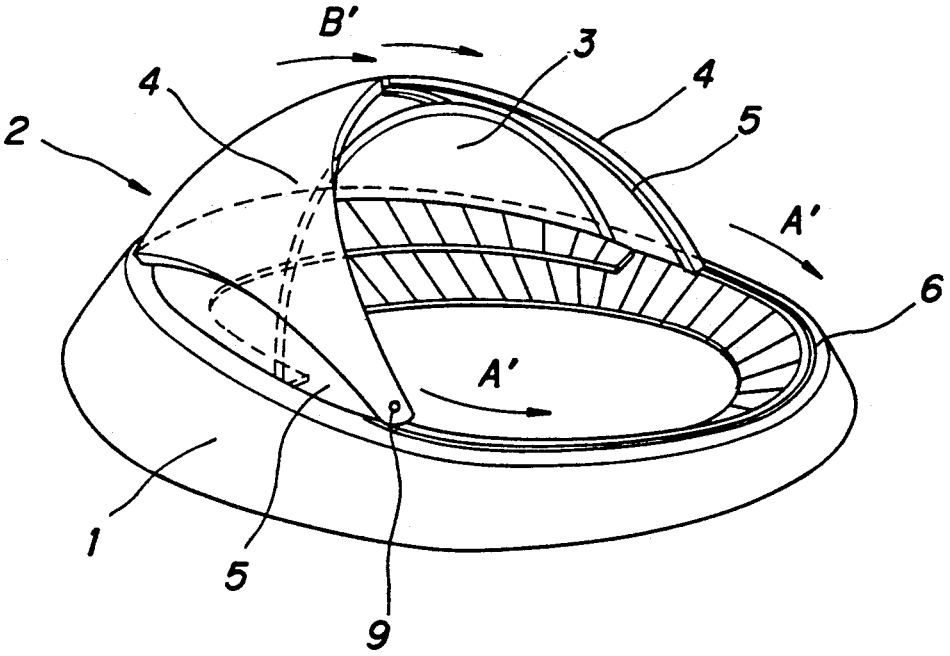
FIG. 14 is a schematic perspective view of the roof structure of the third embodiment in a fully opened position.

Reference is now made to a third embodiment of the present invention in which the same reference numerals are employed to designate the same parts as in the previous embodiment, with reference to FIGS. 12–14.

A dome-shaped roof structure of this embodiment comprises a fixed roof section 3, a pair of pivotable roof sections 4 and a pair of slidable roof sections 5. These roof sections are supported on a circular side wall 1 and arranged to be openable substantially in the same manner as in the second embodiment.

A main difference between the present embodiment and the second embodiment is that the upper end surface of the circular side wall has a gentle down grade from a left hand side as viewed in FIG. 12, which is a center of the outer circular arc of the fixed roof section, to a right hand side as viewed in FIG. 12, where the pivotable roof sections 4 are pivoted to the slidable roof sections 5. Therefore, a guide rail 6 provided on the upper surface of the side wall 1 is also inclined. In FIG. 12, an angle of inclination is shown by "X" and preferably is in the range of 5 to 7 degrees. Other features of the third embodiment are substantially the same as in the second embodiment, so that explanation thereof is omitted herein.

In this embodiment, when the dome-shaped roof is to be opened the slidable roof sections 5 move up along the inclined upper surface of the side wall 1 while rotating along the guide 6 as shown by arrow A in FIG. 13. At this time, the pivotable roof sections 4 move in descending directions along the radially extending guide rails 12*a* as shown by arrows B in FIG. 13. On the other hand, when the opening in the dome-shaped roof is to be closed, the slidable roof sections 5 move in descending directions as shown by arrows A' in FIG. 14, while the pivotable roof sections 4 move in ascending directions as shown in by arrows B'.

This means that in both opening and closing directions of the dome-shaped roof, the force exerted to move the slidable roof sections 4 and the pivotable roof sections 5 are in the opposite directions so that the power required for opening and closing the dome-shaped roof can be greatly reduced. The degree of inclination of the upper surface of the side wall 1 can be determined to optimize the reduction of required power.

Figure 15:
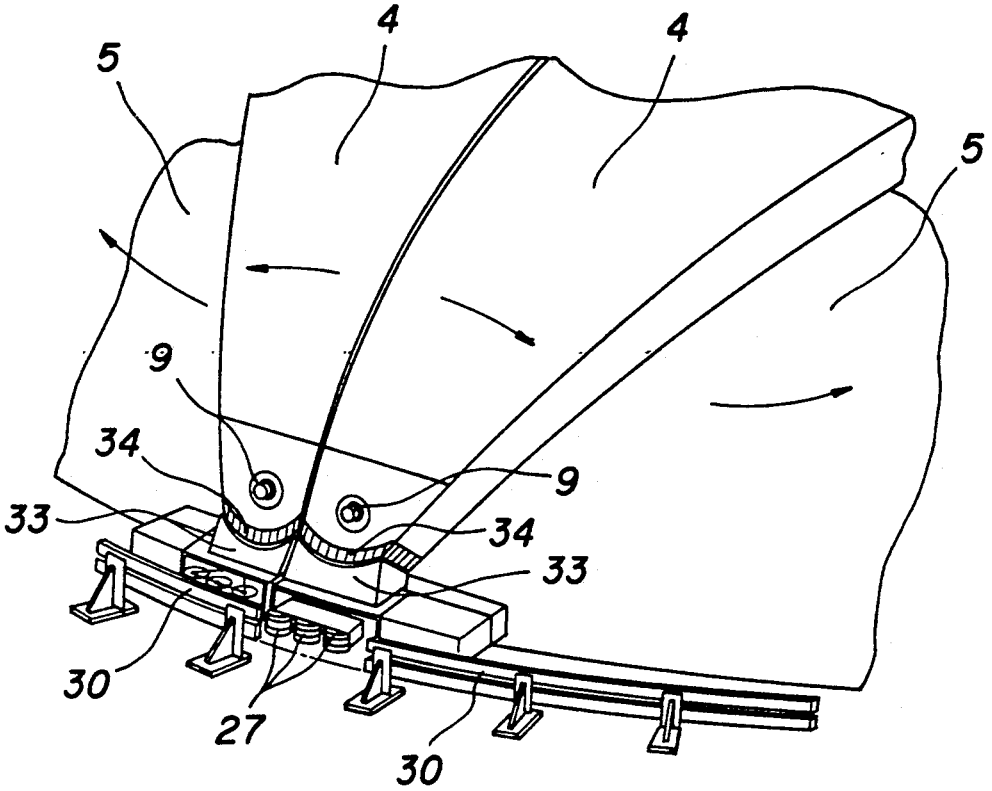
FIG. 15 is a perspective view showing a peripheral end portion of slidable roof sections where a pair of pivotable roof sections pivoted thereto.
Figure 16:
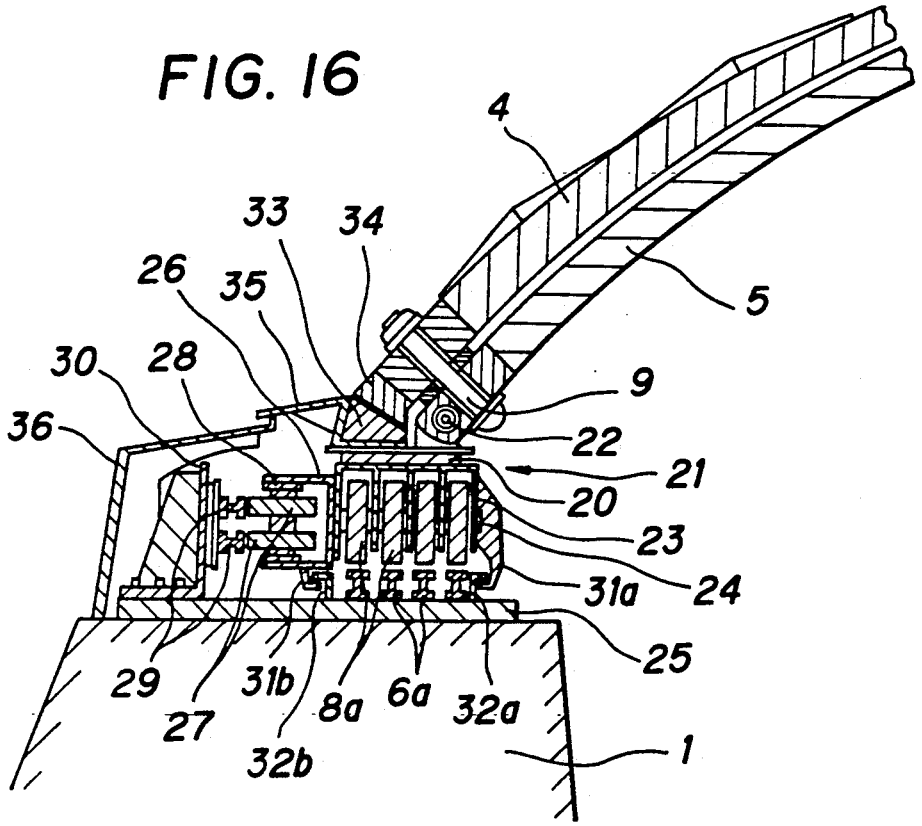
FIG. 16 is a vertical sectional view of the peripheral end portion slidable roof sections shown in FIG. 15.

FIGS. 15 and 16 show a connecting and supporting structure of the pivotable roof sections and slidable roof sections. As set forth above, each pivotable roof section 4 is pivotably connected to the respective slidable roof section 5 positioned thereunder by the respective pivot 9. The slidable roof section 5 is pivotably connected in turn to a supporting frame 20 of a carriage 21 by another pivot 22 which extends at a right angle with respect to the pivot 9 and which extends through a peripheral end portion of the slidable roof section 5. The supporting frame 20 has an inverted U-shaped bracket 23 in which four wheels 8*a* are rotatably supported by a horizontal axle 24. These wheels 8*a* ride on four respective guide rails 6*a* fixed on the upper surface of the side wall 1 by means of a base plate 25. Integrally connected to the outer peripheral side surface of the bracket 23 is a channel-shaped bracket 26 the outer peripheral side of which is open. The bracket 26 supports therein six horizontally arranged wheels 27 by means of vertical axles 28. Wheels 27 are arranged to roll along side rails 29 on a vertical wall panel 30 which is rigidly supported on the side wall 1 by the base plate 25. In order that the wheels 8*a* and 27 may not be derailed from the guide rails 6*a* and side rails 29, respectively, hook shaped members 31*a* and 31*b* are fixedly provided on the brackets 23 and 26 and slidably engage with guide frames 32*a* and 32*b*, respectively, fixed to the base plate 25 on the side wall 1.

The supporting frame 20 has secured on the upper surface thereof cancave supporting members 33, which are made of plastic material having a low coefficient of friction. Each supporting member 33 snugly receives therein a convex member 34 secured to the peripheral end of a respective pivotable roof section 4, the convex member 34 also being made of plastic material having a low coefficient of friction. The concave and convex surfaces of the members 33 and 34, respectively, have substantially the same radius of curvature round the pivot 9. The supporting frame 20 also has a covering member 35 which together with a shading panel 36 attached on the side wall 1, covers over the outer peripheral portion of the carriage 21.

Other carriages similar to that set forth above can be provided at predetermined intervals on the outer peripheral edge of the slidable roof section 4 to achieve slidable support thereof. In this case, of course, since there is no pivotable roof section 4 on the carriage, it is not necessary to provide the concave supporting member 33 on the supporting frame 20 and the slidable roof section 5 is connected to the supporting frame 20 only by the pivot 22.

By using such carriages 21 as set forth above in FIGS. 15 and 16, vibrations which may be imported to the pivotable and slidable roof sections by external forces such as strong wind will not be transmitted to the carriage 21, since such sections can move about the pivot 22. Also, since the concave supporting member 33 slidably contacting the convex member 34 supports the heavy weight of the pivotable roof section 4 together with the pivot 9, smooth rotary movement of the pivotable member 4 is insured. Further, since the horizontal wheels 27 are provided to roll along the side rails 29, in addition to the vertical wheels 8*a*, the sliding movement of the slidable roof section 5 becomes very smooth and reliable.

Figure 17:
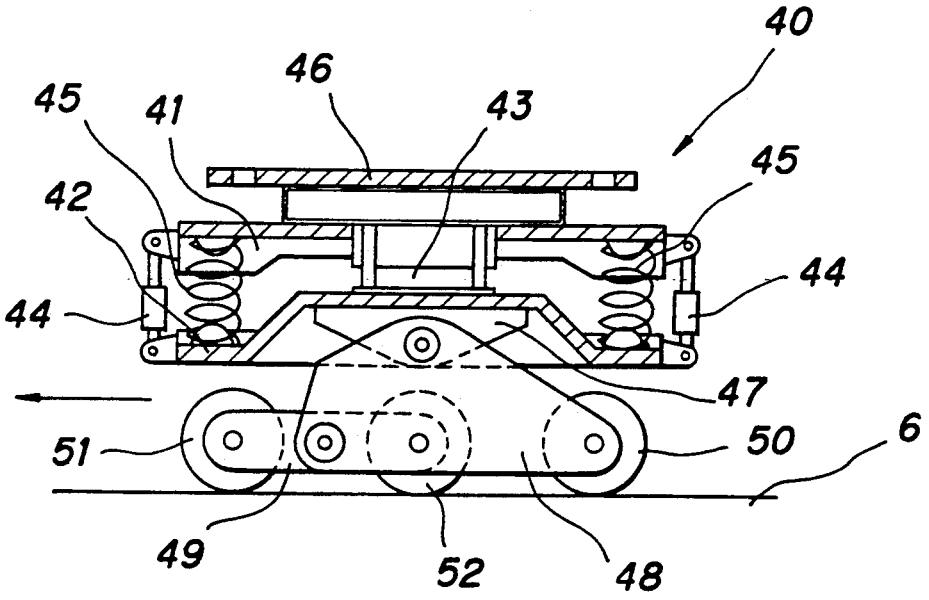
FIG. 17 is a vertically sectioned side view showing a preferred structure of a carriage adapted to support the slidable roof section of the present invention.

FIG. 17 shows another type of carriage 40 for supporting the slidable roof section 5. This carriage 40 can be used as positions except at that position where the pivotable roof section 4 is connected to the slidable roof section 5. This carriage comprises an upper frame 41 and a lower frame 42, both of which are interconnected by a snugly engaged inner and outer cylindrical column 43 so that the space between the frames can be adjusted. The opposite side end portions of the upper and lower frames 41 and 42, respectively, are provided with shock absorbers 44 and compressed coil springs 45. Provided upon the upper frame 41 is a base plate 46 for mounting thereon the peripheral edge of the sliding roof section 5. The lower frame 42 has thereunder a vertical flange 47 to which is pivotably connected a wheel bracket 48. The wheel bracket 48 has a lower front end portion to which is pivotably connected a horizontal wheel bracket 49, and a rear end portion to which is rotatably connected a wheel 50. The horizontal wheel bracket 49 has front and rear wheels 51 and 52 rotatably connected to the front and rear end portions thereof, respectively. Although only one wheel bracket 48 is shown in FIG. 17, another wheel bracket 48 and other associated parts thereof are provided in parallel thereto. These wheels 50, 51 and 52 are arranged to ride on the guide rail 6 fixed on the upper surface of the side wall 1.

With such a structure of the carriage 40, vibrations caused by the slidable roof section 5 or guide rail 6 are absorbed by the shock absorbers 44 and coil springs 45, so that the slidable roof section 5 can be supported stably. The height of the base plate 46 can be changed as desired by adjusting the shock absorbers 44.

Although the present invention has been described with reference to the preferred embodiment thereof, many modifications and alterations may be made within the spirit of the present invention.

We claim:

1. An openable dome-shaped roof structure comprising:

a peripheral side wall;

a first slide guide means provided upon said side wall along a circle;

a crescent-shaped fixed roof section having an arc-shaped outer periphery fixedly supported by said side wall and an arc-shaped inner periphery;

a second slide guide means provided upon said fixed roof section along a circular arc which is concentric with said circle;

a pair of slidable roof sections provided above the level of said fixed roof section and symmetrically arranged relative to a first diametral line of said circle, which line divides said slidable roof sections into equal two parts, said slidable roof sections meeting with each other at a first point where said diametral line intersects with said circle at the opposite side of said fixed roof section, each said slidable roof section being defined by an outer arc portion extending along said circle from said first point to a respective second point where said arc-shaped outer and inner peripheries of said fixed roof section meet with each other, an inner arc portion extending along said arc-shaped inner periphery of said fixed roof section from said second point to a third point where said second slide guide means terminates, and a substantially linear portion extending from said first point to said third point;

a third slide guide means provided upon each said slidable roof section along and near said inner arc portion thereof; a pair of pivotable roof sections symmetrically arranged relative to said diametral line in such a manner that said pivotable roof sections close a space of a dome-shaped roof not covered by said fixed roof section and said slidable roof sections, each said pivotable roof section being provided above the level of a respective said slidable roof section and pivotably connected thereto at a position adjacent said first point;

means for pivotably moving said pivotable roof sections upon said slidable roof sections along said third slide guide means; and means for slidably moving said slidable roof sections upon said fixed roof section along said first and second slide guide means.

2. An openable dome-shaped roof structure as claimed in claim 1, wherein both of said second points on said fixed roof section are provided on a second diametral line on said circle intersecting at a right angle with said first diametral line, said arc-shaped inner periphery of said fixed roof section is defined substantially by a radius of curvature from said first point to one said second point about a center at said first point, and said third point on each said slidable roof section is located at a point which is one fourth of the length of said arc-shaped inner periphery from the respective said second point.

3. An openable dome-shaped roof structure as claimed in claim 1, wherein a fourth slide guide means is provided upon said fixed roof section along said arc-shaped inner peripheral thereof, each of said pivotable roof sections has a first carriage means engagable with said third slide guide means and a second carriage means engagable with said fourth slide guide means, and said means for moving said pivotable roof sections is driven prior to the driving of said means for moving said slidable roof sections.

4. An openable dome-shaped roof structure as claimed in claim 1, wherein a pair of fourth slide guide means are provided upon said fixed roof section substantially in parallel to said first diametral line, each of said pivotable roof sections has a first carriage means engagable with said third slide guide means and a second carriage means engagable with said fourth slide guide means, and said means for moving said pivotable roof sections and said means for moving said slidable roof sections are driven in synchronization with each other.

5. An openable dome-shaped roof structure as claimed in claim 1, wherein said first, second and third slide guide means each includes a rail, each of said slidable roof sections has a plurality of carriage means riding on said rails of said first and second slide guide means, and each of said pivotable roof sections has another carriage means riding upon said rail of said third slide guide means.

6. An openable dome-shaped roof structure as claimed in claim 4, wherein an upper surface of said peripheral side wall, upon which said first slide guide means is provided, has a gradient gradually descending from a position facing to the center part of said arc-shaped outer periphery of said fixed roof section to said first point at an opposite side of said fixed roof section.

7. An openable dome-shaped roof structure as claimed in claim 5, wherein said carriage means for supporting each said slidable roof section comprises a frame pivotably connected to a peripheral end portion of said slidable roof section by a horizontal shaft, a plurality of vertical wheels supported by a horizontal axle on said frame, and a plurality of horizontal wheels supported by a vertical axle at the outer side of said frame, said vertical wheels riding on said rail on said peripheral side wall, said horizontal wheels being arranged to roll along side rails also supported on said peripheral side wall.

8. An openable dome-shaped roof structure as claimed in claim 5, wherein said carriage for supporting said slidable roof section comprises an upper supporting frame, a lower frame adjustably separated from said supporting frame, a plurality of shock absorbers provided between said frames at front and rear portions thereof, wheel brackets pivotably connected at upper end portions thereof to said lower frame, and a plurality of wheels rotatably connected to lower portions of said wheel brackets, said wheels riding on said rail on said peripheral side wall.

9. An openable dome-shaped roof structure as claimed in claim 6, wherein an angle of the gradient of the upper surface of said peripheral side wall is in the range of 5 to 7 degrees.

10. An openable dome-shaped roof structure as claimed in claim 7, wherein said carriage means provided for supporting said slidable roof section at a position where said pivotable roof section is connected to said slidable roof section by a pivot further comprises a concave supporting member secured on the upper surface of said frame, said supporting member snugly receiving therein a convex member secured to a peripheral end of said pivotable roof section, the concave and convex surfaces of said members having substantially the same radius of curvature round said pivot, said concave and convex members being made of plastic material having a low coefficient of friction.

* * * * *